United States Patent [19]

Kifer et al.

[11] 4,410,004

[45] Oct. 18, 1983

[54] LAUNDRY OUTLET BOX

[75] Inventors: David E. Kifer, Parma, Ohio; Robert H. McGuire, Anaheim Hills, Calif.

[73] Assignee: Oatey Co., Cleveland, Ohio

[21] Appl. No.: 137,816

[22] Filed: Apr. 4, 1980

[51] Int. Cl.[3] ..... F16L 5/00

[52] U.S. Cl. ..... 137/360; 174/48; 220/3.92; 285/4; 285/64; 285/119; 285/177; 285/423

[58] Field of Search ..... 285/12, 3, 4, 177, 119, 285/331, 64, 332, 423; 137/360; 312/229, 228, 242, 209, 245, 111; 220/3.2, 3.3, 3.4–3.94, 4 R, 20; 248/27.1; 174/17 R, 48, 55, 57, 58

[56] References Cited

U.S. PATENT DOCUMENTS

| | | | |
|---|---|---|---|
| 2,639,054 | 5/1953 | Austin | 220/3.92 |
| 3,096,782 | 7/1963 | Williams | 137/360 |
| 3,119,887 | 1/1964 | Baehr | 312/229 X |
| 3,662,085 | 5/1972 | Robinson et al. | 174/58 |
| 3,680,896 | 8/1972 | Cupit | 285/177 |
| 3,831,624 | 8/1974 | Doumany | 137/360 |
| 3,834,781 | 9/1974 | Logsdon | 312/229 |
| 3,847,175 | 11/1974 | Anderson | 137/360 |
| 3,980,112 | 9/1976 | Basham | 285/133 R |
| 4,013,309 | 3/1977 | Quick | 285/332 |
| 4,133,312 | 1/1978 | Burd | 285/332 |
| 4,158,471 | 3/1978 | Logsdon | 312/229 |

FOREIGN PATENT DOCUMENTS

| | | | |
|---|---|---|---|
| 704684 | 2/1954 | United Kingdom | 285/177 |

OTHER PUBLICATIONS

Specialty Products Co., Form 196.

*Primary Examiner*—Dave W. Arola
*Attorney, Agent, or Firm*—Maky, Renner, Otto & Boisselle

[57] ABSTRACT

A laundry outlet box comprises a box-like one-piece molded plastic housing having top, bottom and side walls circumscribing an axis of the box and a back wall and open front face normal to such axis. The bottom wall of the housing slopes downwardly toward the center to a drain opening and is provided at its underside with a tailpipe adaptor including coextensive radially spaced pipe-like extensions concentric with the drain opening, which extensions are adapted for selective coupling to drain pipes of different sizes. The housing is adapted to be recess mounted in a wall between vertical wall supports by interchangeable L-shape mounting brackets arranged in pairs on each side of the box with the laterally extending legs vertically spaced apart and adapted to have optionally secured therebetween electrical outlet boxes at one or both sides of the box. One leg of each bracket extends axially into a respective mounting loop on the side wall of the housing and is axially adjustably secured therein so that the box can be mounted in the wall in one of a plurality of axially adjusted positions. The outlet box further includes a face plate which may be axially adjustably attached by snap lock elements to the housing to cover the opening in the wall therefor or optionally by screws to the mounting brackets.

32 Claims, 9 Drawing Figures

LAUNDRY OUTLET BOX

FIELD OF THE INVENTION

This invention relates generally to water supply-drain fixtures such as laundry outlet boxes, and more particularly to a universal laundry outlet box adapted for use in walls where the wall surface materials may be of different thicknesses, and with different sizes of water supply and drain piping. The outlet box may optionally be provided with electrical receptacles of the type commonly required in laundry room environments.

BACKGROUND OF THE INVENTION

Laundry outlet boxes are commonly used today to provide for neat and orderly attachment of the inlet and drain hoses of a washing machine to the water supply and drain piping concealed in the wall of the laundry room. Such boxes may also serve as a container to catch and dispose of any leakage water from the hose connections which otherwise would run into the wall or onto the floor. Accordingly, such boxes are preferably water tight except for the front access opening.

The outlet boxes are usually recess mounted in the wall between vertical wall supports, i.e., wall studs, by one or more mounting brackets or flanges. In many cases, the brackets or flanges are fixed to the box and accordingly the outlet box may only be mounted in one position relative to the wall surface. Depending on the thickness of the material used for the wall surface, i.e., paneling, plaster, or wall board, the front opening of the box may not fit flush with the outer surface of the wall even though such flush fit is usually considered desirable. Moreover, the facing or cover plate commonly utilized to cover the rough-cut opening in the wall surface material may not be able to be properly attached if the wall surface material is too thick. Accordingly, different outlet boxes may be required for use with different wall surface materials.

It is generally known to provide detachable and adjustable mounting brackets for mounting a laundry outlet box in the wall in one of several positions with respect to the wall surface. Such a construction may be seen, for example, in U.S. Pat. No. 4,158,471. However, the outlet box disclosed in such patent only provides for two adjusted positions and is not readily adaptable for providing more than that. Accordingly, the outlet box cannot properly accommodate more than two surface material thicknesses. Moreover, it is not always possible to tell whether or not the box is properly secured in the desired adjusted position, and it is also sometimes difficult to move the box from one adjusted position to another when desired.

Another disadvantage of some known outlet boxes is that they can accommodate only one size of supply pipe or drain pipe. Most supply pipes used today are either copper or galvanized pipe, both of which have a one-half inch internal diameter. However, the outer diameter of the galvanized pipe is greater than that of the copper pipe and thus requires a larger opening in the outlet box. To overcome this deficiency, some boxes employ plural knock-out plugs for the different supply pipes.

With regard to the drain pipe union, it is known to provide tailpipes on the boxes which have an upper larger diameter portion and a lower reduced diameter portion to enable coupling with drain pipes of two different sizes. However, since code requirements commonly require a minimum overlap such as ¾ inch at the drain pipe joint where plastic pipe is being used to provide sufficient cementing surface, heretofore the overall length of the dual-size tailpipe had to be twice that required if only a single tailpipe were employed. Accordingly, the tailpipe projected considerably beyond the bottom of the box thereby adding to the size of the box and requiring larger packaging and storage area.

It is also known to employ removable tailpipes to decrease package size and storage requirements; however, heretofore such tailpipe-box joints provided a trap for standing water which is also undesirable.

Another disadvantage in outlet boxes which also provide for laundry electrical connections is that the electrical outlet boxes are usually mounted in only one position on the sidewalls of the box with the fasteners therefor extending through the sidewalls. This, however, destroys the integrity of the box and provides a direct water path from inside the box to the electrical wiring contained in the electrical outlet box.

SUMMARY OF THE INVENTION

With the foregoing in mind, it is a principal object of this invention to provide an improved laundry outlet box which overcomes many of the drawbacks of known laundry boxes and which in particular has great versatility in use.

According to the invention, a laundry outlet box comprises a one-piece molded plastic housing having top, bottom and side walls circumscribing an axis of the box and a back wall and open front wall normal to such axis. The bottom wall of the housing slopes downwardly to a central drain opening and is provided integrally or as a separate piece with a tailpipe adaptor consisting of two coextensive radially spaced pipe-like extensions concentric with the drain opening which are adapted for selective coupling to drain pipes of different sizes. Where a separate piece adaptor is utilized, the same is cemented into the drain opening and has a downwardly sloping web surface interconnecting the top ends of the extensions which is also flush with and forms an extension of the sloping bottom wall of the housing to preclude standing water. The bottom wall of the housing further is provided with raised ledges having variable size knock-out plugs to accommodate different sizes of water supply tubing.

Further in accordance with the invention, the housing is adapted to be recess mounted in a wall between vertical wall supports, there being provided interchangeable L-shape mounting brackets each having one of its legs extending laterally and being adapted at its distal end for attachment to the wall support. The other leg of each bracket extends axially into a respective mounting loop on the side wall of the housing and is axially adjustably secured therein, there being provided on each such other leg or loop at least one protrusion selectively releasably engageable in any one of a number of axially spaced recesses in the other to define an axially adjusted position of the housing with respect to the bracket. Accordingly, the housing may be axially adjusted on the brackets to accommodate wall surface materials of different thicknesses.

Moreover, the brackets are arranged in pairs on each side of the box with the laterally extending legs vertically spaced apart and adapted to have optionally secured therebetween electrical outlet boxes at one or both sides of the housing. The electrical outlet boxes may be mounted on the brackets by an adjustable flange so that the box face can also be brought flush with the outer wall surface.

The outlet box further includes a face plate which may be axially adjustably attached by snap lock elements to the housing. The snap lock elements consist of axially spaced serrations on the face plate or housing and at least one detent on the other selectively releasably engageable in the recesses formed between the serrations. Dimples may also be provided in the face plate to facilitate locating and making openings therein for optional attachment of the face plate to the brackets by screws.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but some of the various ways in which the principles of the invention may be employed.

DETAILED DESCRIPTION OF THE DRAWINGS

Figure 1:
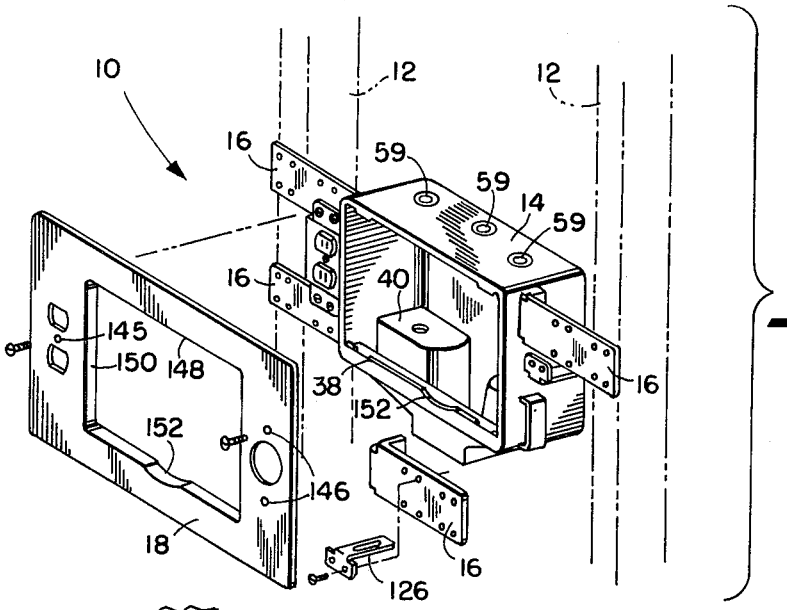
FIG. 1 is an exploded perspective view of a preferred form of laundry outlet box according to the invention.

A laundry outlet box according to the invention is designated generally by reference numeral 10 in FIG. 1 and is adapted to be recess mounted in a wall between vertical wall supports such as wall studs 12. The laundry outlet box 10 generally comprises a box-like housing 14, mounting brackets 16 and face plate 18, the mounting brackets and face plate being detachably secured to the housing during installation of the box in the wall.

Referring now more particularly to FIGS. 2–5, the housing 14 is of a one-piece molded plastic construction including a top wall 20, bottom wall 22, side walls 24 and a back wall 26. The front or face of the housing is open to provide access to plumbing fixtures housed in the box such as hot and cold water valves or faucets 28 and 30 seen in phantom lines in FIGS. 2 and 3. The top wall, bottom wall and side walls circumscribe the axis of the box which is centrally located and extends forwardly and rearwardly with respect to the box and which is illustrated by line 32 in FIGS. 4 and 5.

Figure 5:
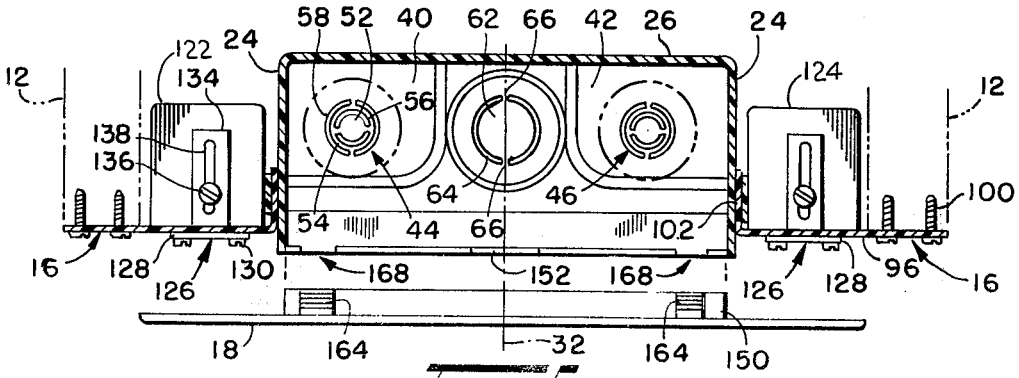
FIG. 5 is an exploded horizontal section through the outlet box taken substantially on the line 5—5 of FIG. 3.

The bottom wall 22 includes a sloping portion 34 which gradually slopes downwardly from the sides toward the center axis 32 and a front lip 36 which extends upwardly from the sloped portion and then forwardly to a frnt edge 38 thereof which is flush with the respective front edges of the side walls 24 and top wall 20. The bottom wall further is provided with two laterally spaced, rearwardly disposed raised ledges 40 and 42 which have respectively on their upper horizontal surfaces knock-out plugs 44 and 46 which can be removed to provide an opening for water supply pipes 48 and 50 for connection to the valves 28 and 30, respectively. Such plugs are preferably of the double knock-out type including a central disc 52 which is separated from a concentric ring 54 by a score groove 56 as best seen in FIG. 5. The ring 54 in turn is separated from the ledges 40 and 42 by score grooves 58. At the score grooves 56 and 58, the plastic ledges form thin breakable membranes. Accordingly, by selective removal of the central disc 52 or ring 54 as by striking with a hammer or other similar tool, a small diameter or a large diameter hole may be formed through which the supply pipes 48 and 50 may pass for connection to the supply valves 28 and 30. The diameter of the small hole preferably is chosen to accommodate a common one-half inch copper pipe, while the diameter of the large hole formed by removing both the central disc and ring is such to accommodate a common one-half inch galvanized pipe. Accordingly, the outlet box installer can selectively knock out one or both plug elements depending on the type of supply piping being used. It should also be appreciated that the housing may be provided with additional knock-out plugs commonly identified by reference numerals 59 in the top wall 20 and side walls 24 to provide versatility in arranging the supply valves in the box, either at the raised ledges 40 and 42, at the side walls 24, at the top wall 20, or at selected combinations thereof, as desired.

Figure 3:
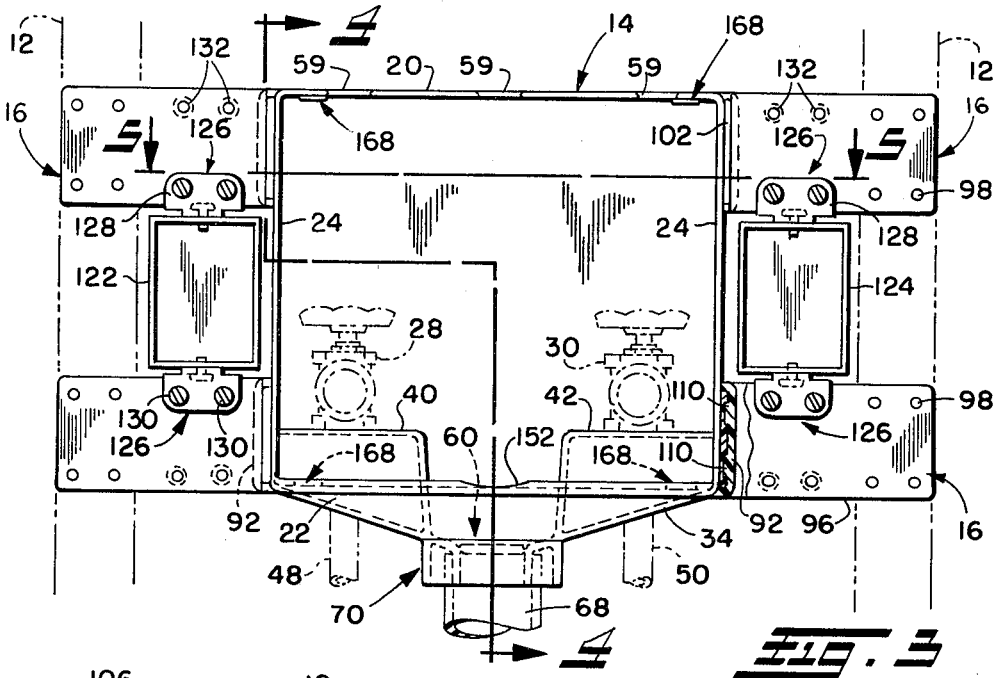
FIG. 3 is a front elevation of the outlet box with the face plate removed to show the box-like housing and mounting brackets therefor.
Figure 4:
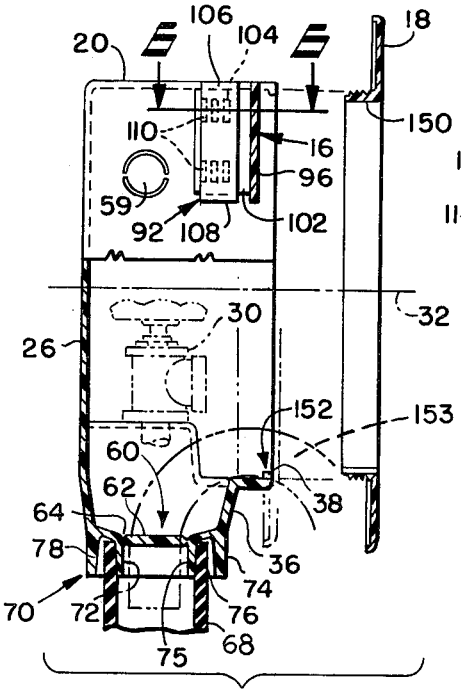
FIG. 4 is an exploded vertical section through the outlet box taken substantially on the line 4—4 of FIG. 3.

As best seen in FIGS. 3 and 4, the sides of the raised ledges 40 and 42, front lip 36 and sloping bottom portions 34 of the bottom wall 22 all slope downwardly in a funnel-like manner to a drain opening 60 at the center of the bottom wall. Although the drain opening will be open in use, it is shown closed by a knock-out plug or test cap 62. The test cap 62 is separated from the bottom wall by a score line 64 forming a frangible membrane which preferably has two diametrically opposed portions of greater thickness which define hinge points 66 about which the test cap will pivot when struck at either side thereof. Accordingly, the test cap can be struck on one side and pivoted about the hinge points, and thereafter can be easily grasped and removed completely from the drain opening without fear of the test cap falling down into the drain pipe 68 which is connected to the drain opening by a tailpipe adaptor 70.

The tailpipe adaptor 70 is desirably molded as an integral part of the housing 14 at the underside of the bottom wall 22 concentric with the drain opening 60 and includes a pair of downwardly extending concentric and coextensive, radially spaced apart pipe-like extensions 72 and 74 to which may be selectively secured drain pipes of two different diameters. The smaller diameter extension 72 at its inner diameter surface 75 forms a continuation of the drain opening 60 while its outer diameter surface 76 is adapted for an interference fit with the inner diameter of one standard size of drain pipe 68 which may be for example a standard one and one-half inch diameter plastic drain pipe. Conversely, the larger diameter extension 74 has an inner diameter surface 78 adapted for an interference fit with the outer diameter of say a standard two-inch plastic drain pipe. Preferably, the inner diameter surface 78 of the larger diameter extension is tapered radially inwardly from its lower end to its upper end while the outer diameter surface 76 of the inner extension is oppositely tapered, that is, tapered radially outwardly from its lower end to its upper end to provide a desired interference fit with the drain pipe 68.

Because the extensions 72 and 74 are coextensive, the tailpipe adaptor 70 need only have a total length slightly greater than the minimum required overlap such as $\frac{3}{4}$ inch between the drain pipe and tailpipe adaptor often required by housing and building codes and still be used to accommodate drain pipe of different sizes, thereby making the adaptor and also the housing 14 quite short and compact to facilitate packaging and storage.

Figure 8:
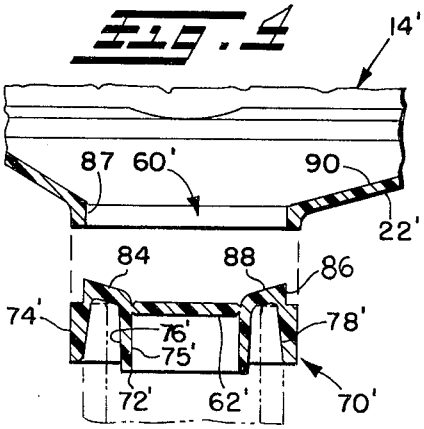
FIG. 8 is an exploded fragmentary vertical section showing an optional separate piece tailpipe adaptor for the housing.

While the tailpipe adaptor 70 shown in FIGS. 3 and 4 is integrally molded in the housing, as will be seen in FIG. 8, wherein primed reference numerals designate elements generally corresponding to those identified above by the same unprimed reference numerals, the tailpipe adaptor may also be made as a separate piece and be solvent welded to the housing at its bottom wall concentric with a modified drain opening. The separate piece tailpipe adaptor 70' shown in FIG. 8 includes two radially spaced, concentric and coextensive pipe-like extensions 72' and 74' interconnected at their upper ends by a web 84. Also at the upper end of the tailpipe adaptor 70' is an annular peripheral groove 86 which mates with and may be solvent cemented to the annular periphery 87 of the drain opening 60'. It will be appreciated that the upper surface 88 of the adaptor when cemented in place will be flush with the inner downwardly sloping surface 90 of the bottom wall 22' and sloped to match or provide a continuation of the slope of the inner surface 90 of the bottom wall 22' to prevent any accumulation of standing water in the housing 14'. The adaptor 70' may also be provided with a knock-out test cap 62'.

The separate piece adaptor 70' will be particularly useful where code requirements call for a PVC plastic tailpipe. Since the housing 14 is preferably made out of ABS plastic, the separate piece tailpipe adaptor 70' made of PVC plastic can be solvent cemented to the ABS plastic housing 14' at the factory in the aforedescribed manner to meet such code requirements. Otherwise, an ABS plastic housing with the integral tailpipe adaptor 70 can be used. While the above materials are preferred, it of course should be appreciated that the housings 14 and 14' and separate piece tailpipe adaptor 70' can be made of still other materials while still achieving advantageous results in accordance with the invention.

It will also be appreciated that the tailpipe adaptor described may have other uses than that shown. For example, the adaptor could be used with appropriate modification wherever it is desired to provide a joint to which different sizes of pipe may be alternately coupled.

Either before or after the above-described plumbing connections are made to the housing 14, the housing may be attached to the wall studs 12 at each side of the housing by the brackets 16, there preferably being two such brackets detachably secured to each side wall 24 of the housing by vertically spaced plastic mounting loops 92 integrally formed as part of the housing on the outer surface 94 of the side walls. The brackets and mounting loops respectively are of like symmetrical construction so that any bracket can be used interchangeably in any mounting loop.

As best seen in FIGS. 3–6, each bracket 16 when viewed from the top is generally L-shape and has a laterally extending leg 96 adapted at its distal end for attachment to the wall stud 12, as by providing a number of holes 98 therethrough for securing the brackets to the wall studs by nails or screws 100. The other leg 102 of each bracket extends axially rearwardly from the proximal end of leg 96 and is inserted into the axially opening mounting loop 92 formed by the side wall 24, an outer loop wall 104 and top and bottom end walls 106 and 108 as best seen in FIGS. 4, 6A and 6B.

Figure 6A:
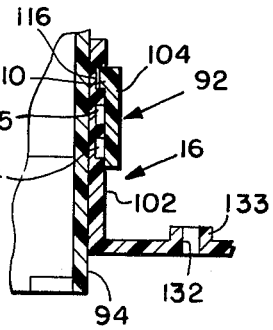
FIGS. 6A and 6B are enlarged partially horizontal sections through the outlet box taken substantially on the line 6—6 of FIG. 4 showing respectively the first and second axially adjusted positions of one of the mounting brackets.
Figure 6B:
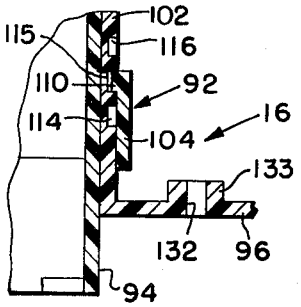

Such axial leg 102 selectively is held in the mounting loop 92 in any one of three axially adjusted positions, two of which can be seen respectively in FIGS. 6A and 6B. Such positions are achieved by the interaction of a pair of vertically spaced laterally extending protrusions 110 integrally formed on the outer loop wall 104 at the back edge thereof with corresponding sets of axially spaced laterally opening recesses 114, 115 and 116 in the axial leg 102 of the bracket, there being provided three such sets of recesses for the three axially adjusted positions described hereinafter. The protrusions 110 are arranged top and bottom in the mounting loop and each are in axial alignment with the corresponding sets of recesses in the bracket leg 102 so that each leg 102 can be pushed into the respective mounting loop selectively to the first position with the protrusions 110 engaged in the rearwardmost recesses 116 as seen in FIG. 6A or to the second position with the protrusions 110 engaged in the middle recesses 115 as seen in FIG. 6B. It will be appreciated that the bracket leg 102 can be pushed still further to engage the protrusions in the forwardmost recesses 114 thus defining the third axially adjusted position. As the leg 102 is pushed into the mounting loop to any one of the three described positions, the outer loop wall 104 being plastic will resiliently distort to permit the leg 102 to pass under the protrusions 110 and then releasably to hold the protrusions engaged in the recesses.

It can now be seen that adjustment of the location of the housing relative to the mounting brackets can be made to accommodate wall surface materials of different thicknesses such as $\frac{1}{4}$ inch, $\frac{1}{2}$ inch and 11/16 inch thick surface materials and to insure that the front face of the housing is flush with the exposed surface of the wall. For example, with a wall surface material thickness of $\frac{1}{4}$ inch, each bracket 16 can be inserted in its respective mounting loop 92 to the first position seen in FIG. 6A so that the front edges of the housing will be flush with the exposed surface of the wall. For a wall surface material of greater thickness, say $\frac{1}{2}$ inch or 11/16 inch, the bracket can be pushed further into the mounting loop to the second or third positions so that the front edge of the housing extends axially forwardly an additional $\frac{1}{4}$ inch of 3/16 inch to bring it flush with the exposed surface of the thicker wall surface material. It of course can be seen that to accommodate either $\frac{1}{4}$ inch, $\frac{1}{2}$ inch, or 11/16 inch thick wall surface materials, the axial spacing between the recesses 115 and 116 is $\frac{1}{4}$ inch and between the recesses 114 and 115 is 3/16 inch.

As mentioned above, there are preferably two brackets 16 detachably secured in mounting loops 92 on each side wall 24 of the housing 14. Moreover, the positions of the mounting loops on the housing side wall are preferably such that the laterally extending legs 96 of the brackets secured thereto are vertically spaced apart so that there may be mounted therebetween electrical outlet boxes 122 and 124 for 120 and 240 volt service, respectively. The outlet boxes 122 and 124 each have at their respective top and bottom ends L-shape mounting elements 126 secured respectively at their vertical flanges 128 to the top and bottom mounting brackets by pairs of screws 130 threaded in holes 132 in the bracket legs, there being provided symmetrically opposed pairs of the holes in the bracket legs so that the brackets can be used interchangeably in any of the mounting loops 92. To provide sufficient length for threading of the holes 132, bosses 133 concentric with the holes 132 may be provided on the bracket legs (see FIGS. 6A and 6B).

The mounting elements 126 are each in turn secured at the other or axial flange 134 to the top or bottom wall of the outlet box by screws 136 threaded in an opening therein. As seen in FIG. 5, an axial slot 138 may be provided in the axial flange 134 through which the screw 136 extends so that the electrical outlet box can be adjusted axially with respect to the mounting bracket and brought into abutment with the inner surface of the face plate 18 when the latter is attached to the housing to cover the rough cut opening for the housing in the wall surface material.

Figure 2:
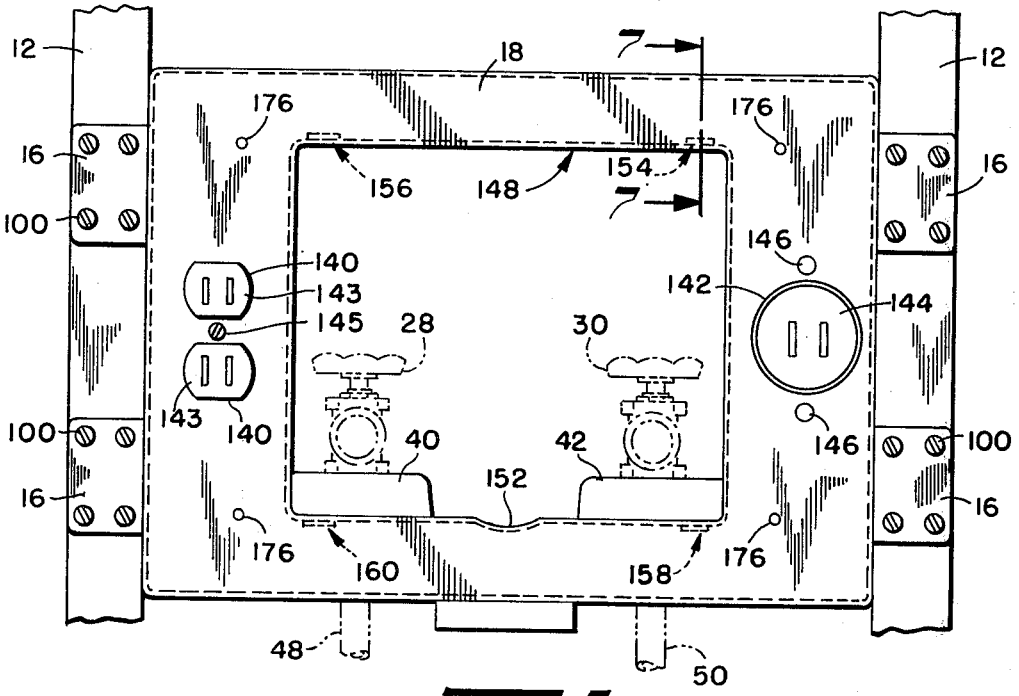
FIG. 2 is a front elevation of the assembled laundry outlet box of FIG. 1.

Reverting to FIG. 2, the face plate 18 which is generally rectangular in shape may be provided with suitable openings 140 and 142 through which the respective receptacle elements 143 and 144 in the electricl outlet boxes 122 and 124 may extend. Screw holes 145 and 146 may be provided in the face plate positioned respectively to be in alignment with the face plate attaching screw holes commonly provided in standard electrical 120 and 240 volt receptacles 143 and 144 when installed in the electrical outlet boxes 122 and 124 to draw the face plate against the electrical outlet boxes if necessary. If electrical receptacles are not desired, the face plate of course need not have openings 140 and 142 or holes 145 and 146. Moreover, such face plate need not be as wide since the wall opening may be smaller when electrical service is not desired.

The face plate 18 further is provided wih a large central rectangular opening 148 generally corresponding in dimension to the open front face of the housing 14 through which access is obtained to the plumbing fixtures in the interior of the housing. The central opening is circumscribed by a rearwardly extending flange 150 on the face plate which extends into the housing to cover or hide any gaps between the face plate and housing at the central opening and to ensure an attractive and water tight appearance. Preferably, the central opening and flange at their respective bottom edges are formed to provide an upwardly opening arcuate notch 152. The arcuate notch 152 is axially in line with the drain opening and is vertically positioned will respect to the drain opening so that a standard goose neck drain tube 153 attached at one end to a washing machine drain hose may be inserted at its other end into the drain opening with the notch laterally locating the goose neck drain tube and holding it at the bight portion thereof at such an elevation that the open end in the goose neck extends beyond the tailpipe adaptor 70 as seen in phantom lines in FIG. 4 thereby to ensure that water flow directly enters the attached drain pipe beyond the solvent cemented joint.

The face plate 18 may be attached to the housing 14 as by four sets of snap lock elements generally identified by reference numerals 154, 156, 158 and 160 in FIG. 2 which sets are symmetrically positioned top and bottom near the four corners of the housing and central opening of the face plate. Each set of elements are of like construction, they being only reversely orientated depending on whether they are positioned top or bottom on the housing and face plate.

Figure 7:
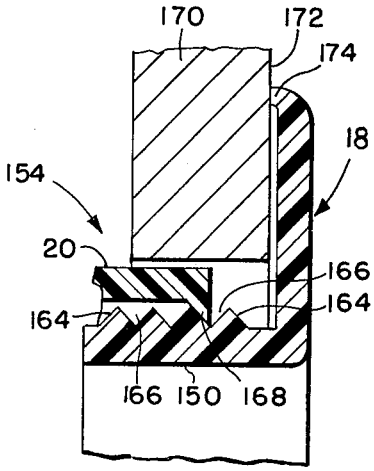
FIG. 7 is an enlarged partial vertical section taken substantially on the line 7—7 of FIG. 2 showing the snap lock elements attaching the face plate to the housing.

As best seen in FIG. 7, each snap lock element set 154 includes on the top and bottom of the flange 150 of the face plate 18 a number of transversely extending axially spaced detents or serrations 164 which define therebetween a number of recesses or notches 166. Adapted to engage in any one of the notches is a single downwardly disposed transversely extending detent 168 on the top wall 20 adjacent each corner of the housing at its front edge. Similar but upwardly disposed detents 168 are likewise provided on the front lip 36 of the bottom wall 22. As a result, the face plate can be releasably or snap locked in any one of a plurality of axially adjusted positions with respect to the housing. As the face plate is pushed into the housing, the flange and housing both being made of plastic, will resiliently distort to permit the detent 168 to pass over the serrations 164 and then to hold the detent in any one of the recesses 166.

It will now be appreciated that the face plate can be attached to the housing flush with the exposed surface of the wall surface material regardless of the latter's thickness. This is best seen in FIG. 7 where the thickness of the wall surface material 170 is shown protruding beyond the front edge of the housing 14 which may occur in some instances where the front edge cannot be brought flush with the wall exposed surface 172. Nevertheless, the face plate can be inserted into the housing until the face plate engages exposed surface 172 and will be held in such position by the detents 168 engaged in opposed recesses 166 on the face plate flange 150. The face plate is preferably relieved by providing a rearwardly extending bead 174 along its outermost edge for firmly engaging the exposed surface of the wall while permitting some flexing of the cover plate to ensure full seating of the detent in a recess and to accommodate any wall irregularities.

Optionally, or in the event the sets of snap lock elements become inoperative, the cover plate 18 may be provided with openings in alignment with the unused holes 132 in the laterally extending legs 96 of the mounting brackets 16 so that the cover plate can be secured at such openings by screws threaded into the unused holes. Preferably and to prevent unsightly holes in the face plate, such openings are drilled or otherwise made in the face plate only when they are to be used to attach the face plate. To facilitate locating and making the openings, dimples 176 may be provided in the face plate in alignment with the unused holes 132 in the mounting brackets, there being one such dimple for each bracket near the four corners of the face plate as seen in FIG. 2.

It can now be appreciated that there is provided a universal laundry outlet box of great versatility and improved construction.

Other modes of applying the principles of the invention may be employed, change being made as regards the details described, provided the features stated in any of the following claims or the equivalent of such be employed.

What is claimed is:

1. A laundry outlet box capable of being recess mounted in a wall between laterally spaced wall supports, comprising: a housing having an axis and an open front face normal to such axis, plural bracket means each having a laterally extending portion adapted at its distal end for attachment to the wall support and an axially extending portion, mounting means for attaching said axially extending portion to said housing in a plurality of axially adjusted positions, and detent means for releasably locking said axially extending portion in one of such axially adjusted positions, said detent means including a plurality of axially spaced laterally opening recesses in said mounting means or axially extending portion and a laterally extending protrusion on the other selectively releasably engageable in any one of said recesses, said mounting means including axially opening mounting loops on opposite sides of said housing, said axially extending portions of said bracket means being receivable in said mounting loops, said protrusions being provided on the inner surface of said loops or the outer surface of said axially extending portions of said bracket means, and said recesses being provided on the adjacent surface of the other of said loops or axially extending portions.

2. The box of claim 1 wherein said housing is box-like including top, bottom and side walls circumscribing such axis and a rear wall normal to such axis, said mounting loops being integral with said side walls, and said bracket means including a plurality of interchangeable brackets attached to said housing at each respective mounting loop and extending laterally therefrom for attachment to the wall supports.

3. The box of claim 2 wherein there are two such mounting loops and brackets arranged top and bottom on each side wall.

4. A laundry outlet box capable of being recess mounted in a wall between laterally spaced wall supports comprising: a housing having an axis and an open front face normal to such axis, plural bracket means each having a laterally extending portion adapted at its distal end for attachment to the wall support and an axially extending portion, mounting means for attaching said axially extending portion to said housing in a plurality of axially adjusted positions, and detent means for releasably locking said axially extending portion in one of such axially adjusted positions, said detent means including a plurality of axially spaced recesses in said mounting means or axially extending portion and a protrusion on the other selectively releasably engageable in any one of said recesses, said housing being box-like including top, bottom and side walls circumscribing such axis and a rear wall normal to such axis, said mounting means including a plurality of mounting loops integral with said side walls, and said bracket means including a plurality of interchangeable brackets attached to said housing at each respective mounting loop and extending laterally therefrom for attachment to the wall supports, there being two such mounting loops and brackets arranged top and bottom on each side wall, said laterally extending portions of said brackets at each side wall being vertically spaced apart and adapted to have mounted therebetween an electrical outlet box, and means for axially adjustably mounting said outlet box on and between said brackets.

5. A laundry outlet box capable of being recess mounted in a wall between laterally spaced wall supports, comprising: a housing having an axis and an open front face normal to such axis, plural bracket means each having a laterally extending portion adapted at its distal end for attachment to the wall support and an axially extending portion, mounting means for attaching said axially extending portion to said housing in a plurality of axially adjusted positions, and detent means for releasably locking said axially extending portion in one of such axially adjusted positions, said detent means including a plurality of axially spaced recesses in said mounting means or axially extending portion and a protrusion on the other selectively releasably engageable in any one of said recesses, a face plate for said front face, and detent means for securing said face plate to said housing in a plurality of axially adjusted positions.

6. The box of claim 5 wherein said detent means includes axially spaced recesses in said housing or face plate and a detent on the other cooperating with said axially spaced recesses for releasably locking said face plate in any one of such plurality of adjusted positions, said recesses and detent means resiliently urged into engagement.

7. The box of claim 6, wherein said face plate has a rearwardly extending flange and a plurality of axially spaced serrations thereon defining therebetween said recesses.

8. The box of claim 5 further comprising optional means for securing said face plate to said housing or bracket means, said bracket means or housing having therein at least one mounting hole, and said face plate including thereon indicia means for locating an opening to be formed therein in line with said mounting hole whereby such opening can be provided when needed and a suitable fastener employed to attach the face plate in place.

9. The box of claim 5 wherein said housing has a bottom wall with a drain opening therein, said face plate having four vertical side portions defining therebetween a central opening giving access to the interior of said housing through said open front face, the bottom vertical side portion of said face plate having at its upper edge an upwardly opening notch in alignment with said drain opening for locating a drain hose goose neck in said housing with its open end in said drain opening.

10. A laundry outlet box capable of being selectively coupled to drain pipes of different diameters, comprising a box-like housing having a bottom wall with a drain opening therein and selective coupling means depending from said bottom wall at said drain opening for selectively coupling to said housing drain pipes of different diameters, said coupling means including two radially spaced, coextensive inner and outer pipe-like extensions each adapted to have coupled thereto respective ones of the different diameter drain pipes, said radially inner and outer extensions respectively having oppositely tapered outer and inner diameter surfaces for achieving interference fit with the inner and outer surfaces of the respective drain pipes.

11. The box of claim 10 wherein said opposed surfaces are each about $\frac{3}{4}$ inch in a length.

12. The box of claim 10 wherein said housing and selective coupling means are made of plastic with said coupling means molded as an integral part of said bottom wall of said housing, said bottom wall sloping downwardly toward the center to said drain opening which is coextensive with said coupling means.

13. The box of claim 10 wherein said selective coupling means is formed as a separate piece adapted for attachment to said housing at said drain opening and further includes a radially extending web connecting said extensions at the upper ends.

14. The box of claim 13 wherein said housing and selective coupling means are made of a plastic material and the latter is fixedly attached to the former by cement.

15. The box of claim 14 wherein said housing and selective coupling means are made of different plastic material.

16. The box of claim 14 wherein said bottom wall of said housing slopes downwardly to said drain opening, and said web is correspondingly sloped to form a continuation of said sloped bottom wall.

17. The box of claim 16 wherein said web includes a peripheral outer groove for mating engagement with the circumferential edge of said drain opening in said bottom wall.

18. The box of claim 10 wherein said bottom wall includes raised ledges having top horizontal portions, and variable size knock-out plugs integrally formed in said horizontal portions for accommodating different sizes of water supply pipes.

19. The box of claim 10 wherein said selective coupling means has a central opening in communication with said drain opening and a removable test plug in said central opening integrally attached to said selective coupling means by a breakable membrane, said membrane having two diametrically opposed portions of greater thickness which define hinge points about which said test plug will pivot when struck on either side of said hinge points.

20. A laundry outlet box adapted to be recess mounted in a wall between laterally spaced wall supports comprising a box-like housing having top, bottom, side and rear walls, and a pair of vertically spaced brackets on each said side wall adapted to be attached at their distal ends to the wall support, and means for mounting and supporting an electrical outlet box between at least one pair of said brackets adjacent one side of said housing, said electrical outlet box being mounted on said one pair of said brackets.

21. The box of claim 20 further comprising means for axially adjustably securing said brackets to their respective side walls, and means for axially adjustably mounting said electrical outlet box between at least one pair of said brackets adjacent one side of said housing.

22. A laundry outlet box capable of being recess mounted in a wall between laterally spaced wall supports comprising: a housing having an axis and an open front face normal to such axis, plural bracket means each having a laterally extending portion adapted at its distal end for attachment to the wall support and an axially extending portion, mounting means for attaching said axially extending portion to said housing in a plurality of axially adjusted positions, and detent means for releasably locking said axially extending portion in one of such axially adjusted positions, said detent means including a plurality of axially spaced recesses in said mounting means or axially extending portion and a protrusion on the other selectively releasably engageable in any one of said recesses, said housing having a bottom wall with a drain opening therein and selective coupling means depending from said bottom wall at said drain opening for selectively coupling to said housing drain pipes of different diameters, said selective coupling means including two radially spaced, coextensive inner and outer pipe-like extensions each adapted to have coupled thereto respective ones of the different diameter drain pipes, said radially inner and outer extensions respectively having oppositely tapered outer and inner diameter surfaces for achieving an interference fit with the inner and outer surfaces of the respective drain pipes.

23. The box of claim 22 wherein said selective coupling means is formed as a separate piece adapted for attachment to said housing at said drain opening and further includes a radially extending web connecting said extensions at the upper ends.

24. The box of claim 23 wherein said bottom wall of said housing slopes downwardly to said drain opening, and said web is correspondingly sloped to form a continuation of said sloped bottom wall.

25. The box of claim 24 wherein said housing and selective coupling means are made of different plastic materials.

26. A laundry outlet box capable of being recess mounted in a wall between laterally spaced wall supports, comprising: a housing having an axis and an open front face normal to such axis, plural bracket means each having a laterally extending portion adapted at its distal end for attachment to the wall support and an axially extending portion, mounting means for attaching said axially extending portion to said housing in a plurality of axially adjusted positions, and detent means for releasably locking said axially extending portion in one of such axially adjusted positions, said detent means including a plurality of axially spaced recesses in said mounting means or axially extending portion and a protrusion on the other selectively releasably engageable in any one of said recesses, said housing being box-like including top, bottom and side walls circumscribing such axis and a rear wall normal to such axis, said mounting means including a plurality of mounting loops integral with said side walls, and said bracket means including a plurality of interchangeable brackets attached to said housing at each respective mounting loop and extending laterally therefrom for attachment to the wall supports, there being two such mounting loops and brackets arranged top and bottom on each side wall, said laterally extending portions of said bracket at each side wall being vertically spaced apart and having mounted therebetween an electrical outlet box, said electrical outlet box being mounted on said laterally extending portions of said brackets.

27. A laundry outlet box capable of being recess mounted to a wall between laterally spaced wall supports, comprising: a housing having an axis and an open front face normal to such axis, plural bracket means each having a laterally extending portion adapted at its distal end for attachment to the wall support and an axially extending portion, mounting means for attaching said axially extending portion to said housing in a plurality of axially adjusted positions, and detent means for releasably locking said axially extending portion in one of such axially adjusted positions, said detent means including a plurality of axially spaced laterally opening recesses in said mounting means or axially extending portion and a laterally extending protrusions on the other selectively releasably engageable in any one of said recesses, said mounting means including plural axially opening mounting loops integral with said housing, and each said bracket means including an L-shape bracket having its axially extending portion receivable in said mounting loops, said protrusions being provided on the inner surface of said loops, and said recesses being provided on the adjacent surface of said axially extending portions.

28. The box of claim 27 wherein there are two sets of cooperating protrusions and recesses arranged in each said mounting loop in transaxially spaced relationship, said laterally extending portions extending horizontally and said sets being arranged top and bottom in said mounting loops.

29. A laundry outlet box having provision for locating a drain hose goose neck therein comprising a housing having an open front face and a bottom wall with a drain opening therein, and a face plate detachably secured to said housing surrounding said open front face, said face plate having four vertical side portions defining therebetween a central opening giving access to the interior of said housing through said open front face, the bottom vertical side portion of said face plate having at its upper edge an upwardly opening notch in alignment with said drain opening for locating a drain hose goose neck in said housing with its open end in said drain opening, said housing including tailpipe means for selectively coupling drain pipes of different diameters thereto, said tailpipe means including two radially spaced, coextensive inner and outer pipe-like extensions each adapted to have coupled thereto respective ones of the different diameter drain pipes, said radially inner and outer extensions respectively having oppositely tapered outer and inner diameter surfaces for achieving an interference fit with the inner and outer surfaces of the respective drain pipes, said tailpipe means being relatively compact and short in length whereby said goose neck extends downwardly beyond said tailpipe means.

30. A laundry outlet box capable of being recess mounted in a wall between laterally spaced wall supports, comprising: a housing having an axis and an open front face normal to such axis, plural bracket means ach having a laterally extending portion adapted at its distal end for attachment to the wall support and an axially extending portion, mounting means for attaching said axially extending portion to said housing, a face plate for said front face, and detent means for securing said face plate to said housing in a plurality of axially adjusted positions, said detent means including axially spaced recesses in said housing or face plate and a detent on the other cooperating with said axially spaced recesses for releasably locking said face plate in any one of such plurality of adjusted positions, said recesses and detent means resiliently urged into engagement.

31. The box of claim 30, wherein said face plate has a rearwardly extending flange and a plurality of axially spaced serrations thereon defining therebetween said recesses.

32. A laundry outlet box capable of being recess mounted in a wall between laterally spaced wall supports, comprising: a housing having an axis and an open front face normal to such axis, plural bracket means each having a laterally extending portion adapted at its distal end for attachment to the wall support and an axially extending portion, mounting means for attaching said axially extending portion to said housing, a face plate for said front face, detent means for securing said face plate to said housing in a plurality of axially adjusted positions, and optional means for securing said face plate to said housing or bracket means, said bracket means or housing having therein at least one mounting hole, and said face plate including thereon indicia means for locating an opening to be formed therein in line with said mounting hole whereby such opening can be provided when needed and a suitable fastener employed to attach the face plate in place.

* * * * *